US006269616B1

(12) United States Patent
Plefka et al.

(10) Patent No.: US 6,269,616 B1
(45) Date of Patent: Aug. 7, 2001

(54) POUCH MACHINE FOR MAKING VARIABLY-SIZED POUCHES

(75) Inventors: Thomas J. Plefka, Chicago; John Rzeszutko, Roselle; Joe W. Vinsik, Morton Grove, all of IL (US)

(73) Assignee: Cloud Corporation LLC, Des Plaines, IL (US)

( * ) Notice: Subject to any disclaimer, the term of this patent is extended or adjusted under 35 U.S.C. 154(b) by 0 days.

(21) Appl. No.: 09/411,696

(22) Filed: Oct. 1, 1999

(51) Int. Cl.[7] ..... B65B 43/02
(52) U.S. Cl. ..... 53/562; 53/385.1
(58) Field of Search ..... 53/468, 469, 385.1, 53/562, 455

(56) References Cited

U.S. PATENT DOCUMENTS 3,821,873 * 7/1974 Benner, Jr. et al. .
4,956,964 * 9/1990 Jones et al. .
5,315,807 * 5/1994 Restle et al. .
5,605,183 2/1997 Hartman et al. .
5,687,551 * 11/1997 Mustain et al. .
5,699,653 12/1997 Hartman et al. .
5,709,069 * 1/1998 Cronauer ..... 53/385.1
6,050,061 * 4/2000 Todd et al. .

* cited by examiner

*Primary Examiner*—Eugene Kim
(74) *Attorney, Agent, or Firm*—Wood Phillips VanSanten Clark & Mortimer

(57) ABSTRACT

A pouch machine continuously forms a series of multi-pitch, multi-product pouches in a continuous web of pouch material by folding the web and then forming spaced side seals to define a pouch closed on three sides with an initially unsealed mouth on top. The pouch is opened to its maximum volume prior to filling by pressurizing the pouch. Pressurization is achieved by introducing a curtain of compressed air under a plate and passing the mouths of the pouches adjacent the plate and thus through the air curtain. First and second plates engage the front and back panels of the pouches to assure correct pressurization of the pouches.

10 Claims, 5 Drawing Sheets

12C
96
98
12B
79
80
72
74
70
3
82
68
77
58
88
76
77
59
64
60
70
72
3
82
80
C
38
12A
B
12
56
54
56
56

POUCH MACHINE FOR MAKING VARIABLY-SIZED POUCHES

BACKGROUND OF THE INVENTION

This invention relates to a machine and method for continuously forming a series of filled packages or pouches from a continuous strip or web of flexible material. Pouches of this type have long been used to package a wide variety of products such as sugar, sweeteners, drink mixes, soup mixes and the like in individual or small serving sizes. Liquid products as well as dry products can be packaged in this type of pouch. A variety of web materials can be used such as paper or foil which are relatively stiff and non-extensible or oriented polypropylene or polyester which are somewhat soft and extensible. The web may be coated on at least one side with a heat sealable material such as polyethylene which is suitable for forming heat seals.

An example of a prior art pouch machine is shown in U.S. Pat. No. 5,699,653, the disclosure of which is incorporated herein by reference. The typical pouch machine includes a base supporting various components including an unwind stand for supporting a roll of pouch material. The web is unwound in a generally horizontal plane and advanced to a plow which folds the web generally in half about a longitudinal fold line. The fold line is disposed at the bottom of the web which then assumes a generally V-shape with front and back panels on either side of the fold in a substantially vertical plane.

The folded web is then pulled around a rotary vertical sealer which has a series of vertically extending circumferentially spaced heated lands on its periphery which are provided to form longitudinally spaced, vertically extending heat seals in the web. This sealing process forms pockets or pouches between the front and back panels of the web. The tops or mouths of the pouches remain open for filling at a filling wheel which opens the pouches and inserts the desired quantity of the product being packaged. Thereafter, the web is moved to a top sealer which seals the tops. The filled and sealed pouches are transferred to a knife which severs the pouches into individual pouches or groups of pouches.

Sometimes pouch machines have been set up to form pouches or connected groups of pouches having different products in adjacent pouches, e.g., multi-flavor packs of drink mixes. U.S. Pat. No. 5,605,183 shows an example of a filling wheel for filling different products. Recently this multi-product concept has been extended to comestibles having two or more components packaged separately which the user mixes or otherwise prepares at the time of use. These components can be packaged in adjacent, non-separated pouches, as in the case of multi-flavor packs. But in some instances the components may have markedly differing characteristics. For example, macaroni and cheese has a first component which is a powder cheese flavoring mix and a second component which is a somewhat voluminous dry pasta product. In a typical single serving size the volume of the pasta is much greater than that of the appropriate amount of flavoring mix. So while a fairly large pouch volume is required to accommodate the pasta a much smaller volume is sufficient for the flavoring mix. Obviously in this instance if all pouches are of the same size the pouch will be not be the optimum size for one component or the other. If a small pouch appropriate for the flavoring mix is used then multiple pouches will be required for the pasta. This is not the best situation because it complicates the preparation instructions. If a pouch large enough for the pasta is used, the flavoring mix will nowhere near fill it. This latter instance is undesirable because consumers have a tendency to believe they have been sold either a defectively filled package or a miserly amount of flavoring mix when in fact neither is the case.

A solution to this dilemma is to make a small pouch for the flavoring mix and a large pouch for the pasta. The combination of a small and a large pouch will be referred to herein as a package. Thus, a package contains at least two pouches of different widths or pitches which are not separated from one another and contain different products. The package can be described as being multi-pitch and multi-product. The non-separated pouches may be perforated or scored at the adjoining seal to facilitate separation by the ultimate consumer.

Multi-pitch packages have been made in the past on intermittent motion machines. These are machines where the web of pouch materials alternately starts and stops as it makes its way through the various stations. In other words a particular pouch advances to a station, stops, has an operation performed on it while stationary at that station, then moves to the next station where the next operation is performed while stationary, and so on. On an eight and a half inch package width, intermittent machines might be able to produce 100 packages per minute. The present invention provides a continuous pouch making machine having a five-fold increase in production of multi-pitch, multi-product packages.

One of the problems with high speed continuous pouch packaging machines is the need to open the pouches for filling. It will be appreciated that after folding and formation of the side seals, the web is essentially a flat, two-dimensional structure which must be expanded into a three-dimensional form for the pouch to accept the product therein. The above-referenced U.S. Pat. No. 5,699,653 provides an air curtain that inflates the pouches with compressed air. The present invention provides an enhancement to the air curtain of the 5,699,653 patent that is particularly advantageous with multi-pitch, multi-product packages.

SUMMARY OF THE INVENTION

The present invention inflates the pouches of multi-pitch packages just prior to filling by introducing pressurized air into the pouch while limiting the avenues for the air to escape the pouch and be dispersed. In accordance with the invention the mouth of each pouch is carried into a zone or curtain of pressurized air. The upper portions of the front and back panels are engaged by spaced first and second plates, respectively. Air may be introduced between these two plates.

Preferably each pouch has a lip. A lip results when the top edges of the front and back panels are not co-terminous, i.e, one panel is higher than the other. A permanent lip is formed by unbalanced folding of the web. A temporary lip may be formed by a plow or cam disposed downstream of the main folding plow but prior to the vertical heat sealer. The cam folds over a ribbon or tongue of the pouch stock of about 1/32" or more width, preferably on the front panel of the pouch. Since the ribbon or tongue portion is folded down, the heat sealer does not place a vertical seal in the area of the tongue. After filling but before the web enters the top sealer, the tongue is plowed back up by a second plow or cam to its original position. Then the top sealer closes the top edge of the pouch in a balanced package.

Underneath the plates the curtain of pressurized air enters the mouth of the pouch. The upper edge of the back panel is preferably in contact with the bottom surface of an upper plate to seal off the rear or back side of the pouch. The upper edge of the front panel is preferably in contact with the bottom surface of a lower plate to seal off the front panel. With this arrangement the air has no path available other than into the pouch.

DETAILED DESCRIPTION OF THE INVENTION

Figure 1:
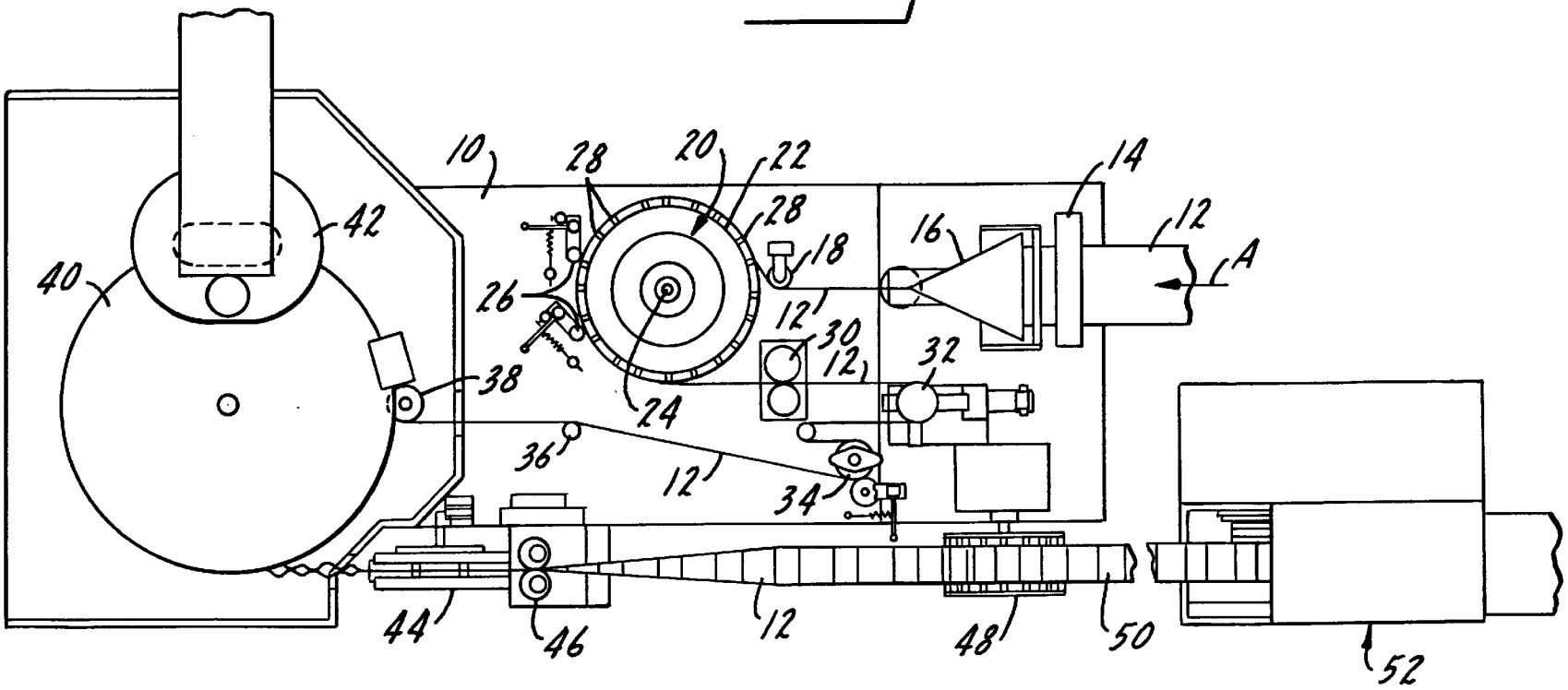
FIG. 1 is plan view of the pouch machine of the present invention.

A typical pouch machine layout is shown in FIG. 1. The machine includes a base 10 on which the various components of the machine are mounted. Alternatively-operable first and second driven unwind stands (not shown) play out a continuous web 12 of pouch material in a generally horizontal plane. The unwind stands may include a device known in the art as a dancer. The dancer accepts the web 12 unwound from the stands and lets out or takes up slack as needed to maintain proper tension on the web as it moves downstream in the direction of arrow A. From the dancer the web advances to registration rollers. A registration scanner indicated schematically at 14 reads a registration symbol or mark, sometimes called an eye spot, on the web and adjusts the feed rate of the registration rollers as needed to assure proper longitudinal alignment of the web as it enters the vertical sealer. Lateral alignment of the web is achieved with a driven plow 16. The plow 16 folds the web up into a vertical plane about a longitudinal fold line which forms the bottom edge of a pouch.

An idler wheel 18 guides the folded web 12 into a rotary vertical heat sealer 20. The sealer has a sealer wheel 22 mounted on a drive shaft 24. Backup rollers 26 are used to keep the web 12 in contact with heated vertical lands 28 on the periphery of the sealer wheel 22 which form the side seals of the pouches. The lands have a variable pitch or circumferential spacing. This spacing causes the side seals to be formed at the desired variable pitch so the pouches have different widths.

A folding plow or cam may be provided upstream of the sealer 20 to fold over a ribbon having a width of about an eighth of an inch at the top edge of one panel of the web. This provides a temporary lip which facilitates opening of the pouches as will be set forth hereinafter. If a lip has been formed on the pouch it will remain unsealed at the vertical sealer 20.

First driven feed rollers 30 pull the web of partially-formed pouches around idler rollers 32 and 34. The web then passes around idler 36 and through a web height guide before entering the tucker roller 38 adjacent the filling wheel. The web height guide adjusts the height of the web as it enters the vacuum transfer wheel.

The product feed deck of a filling wheel is shown at 40. It will be understood that beneath the feed deck 40 is a vacuum transfer wheel which, together with the pouch opening device of the present invention, will be described below. The product being packaged in the pouches is supplied to the feed deck by a product feed mechanism 42. The feed mechanism can be an auger, a belt feeder, or a metering block and plow depending on the handling characteristics of the product.

After the pouches are filled by the filler wheel, the web 12 passes a lip closing plow, if a folded lip is used. The plow folds the ribbon back up to balance the front and back panels of the pouches, leaving a no-lip pouch. Next the web enters a top sealer 44. The top sealer seals the open top edge of the filled pouches. Second driven feed rollers 46 pull the web through the top sealer 44. A squirrel cage 48 may be mounted at the far end of the base 10. The squirrel cage is a driven wheel with transverse rods that gradually rotates the web of completed pouches from a vertical plane to a horizontal plane. The squirrel cage feeds the web onto a conveyor 50 which carries the web to a downstream knife 52. The knife cuts the web through every other side seal to sever the web into finished packages. The cut packages are then fed to a suitable collation unit, e.g, a constant motion cartoner. The cartoner places the packages into boxes, cartons or the like.

Figure 2:
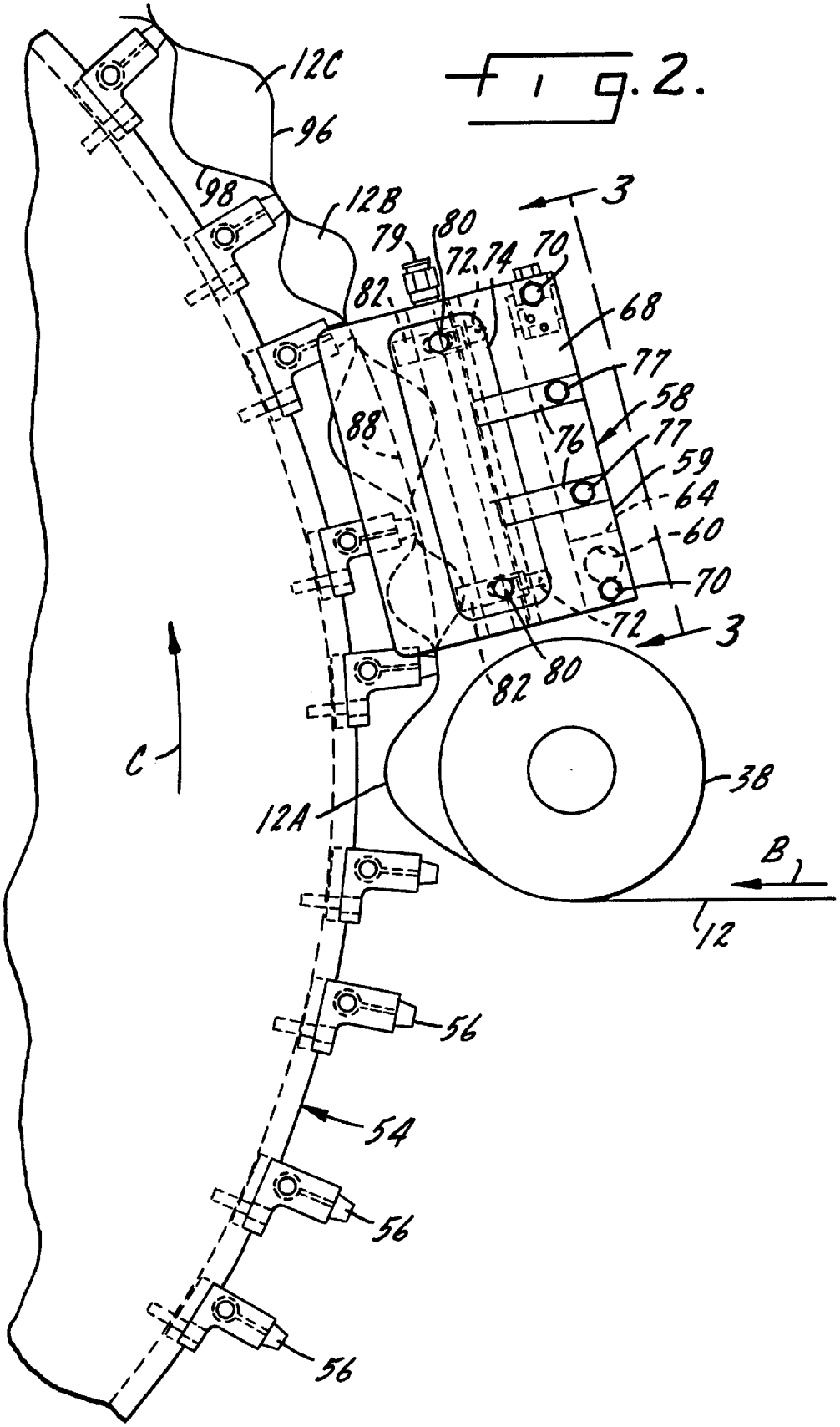
FIG. 2 is a plan view of a portion of a vacuum transfer wheel, showing the pouch opening device of the present invention on an enlarged scale compared to FIG. 1.
Figure 3:
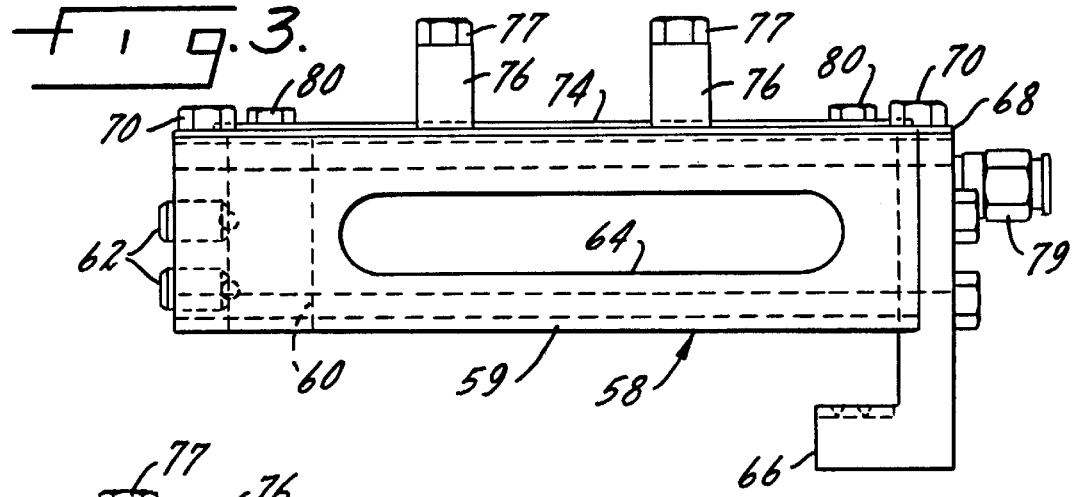
FIG. 3 is a side elevation view of the air delivery case, on an enlarged scale, looking radially of the vacuum transfer wheel in the direction of line 3—3 of FIG. 2.
Figure 4:
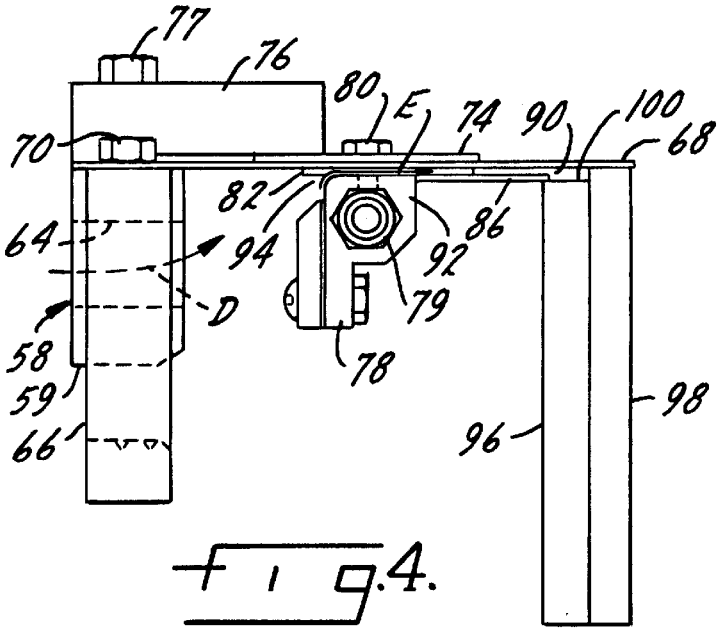
FIG. 4 is a side elevation view of the pouch opening device, looking tangentially of the vacuum transfer wheel.

The pouch opening device of the present invention is shown in FIGS. 2–4. The web 12 of formed but unfilled pouches is fed by the tucker rollers 38 onto a vacuum transfer wheel 54, as indicated by arrow B. The vacuum transfer wheel is mounted below the filling deck of a filling wheel for rotation therewith in the direction of arrow C. A plurality of vertically extending lands 56 are spaced about the periphery of the vacuum transfer wheel 54. As seen in FIG. 2, the circumferential spacing of the lands is variable to match the variable pitch of the pouches. The lands 56 engage the side seals of the pouches as is conventional. The lands have vacuum ports therein (not shown) which are connected to a vacuum source to hold the side seal portions of the web fixed on the transfer wheel during filling operations. The spacing of the filler wheel lands 56 is somewhat less than the pitch of the side seals when the web is flat. As the web is fed onto the wheel 54, the tucker roller 38 overspeeds the web somewhat compared to the linear speed of the lands 56. This compresses the web slightly and aligns the side seals with the lands, thereby allowing the pouches to expand when pressurized.

The web is fed onto the vacuum transfer wheel underneath an air knife head assembly 58. The head assembly includes a pivot bar 59 which has a vertical bore 60 there-through for receiving a mounting post (not shown). The post is attached to the machine base 10. A pair of spring plungers 62 (FIG. 3) extend into the bore 60 to engage the post and adjustably fix the pivot bar 59 on the post. An oval-shaped window 64 extends through the pivot bar to provide additional air flow (as shown by arrow D) to the air knife. The air knife is described below. A locking plate 66 is bolted to the end of the pivot bar opposite the plungers 62.

The top edge of the pivot bar 59 supports a first or upper air knife plate 68. Plate 68 is fastened to the bar 59 by bolts 70. The plate has a pair of elongated slots 72. A slot cover 74 rests on top of plate 68, generally over the slots 72. A pair of braces 76 are fastened to the pivot bar 59 by bolts 77. The braces have a notch on their bottom edges that accommodates the thickness of the slot cover 74. So the bottom edge of the brace engages the top surface of the slot cover to help retain the cover in place.

Underneath the first air knife plate 68 is an air knife 78. A connector 79 at one end of the knife is connected to a conventional pressurized air supply. Further details of the air knife are described in the 5,699,653 patent. The air knife 78 is mounted by two screws 80 threaded into the case of the knife. Screws 80 extend through the upper plate slots 72 with their heads engaging the slot cover 74. Sandwiched between the air knife 78 and the upper plate are two mounting tabs 82. The mounting tabs are aligned with slots 72 and have elongated slots of their own. The screws 80 extend through these slots. The two sets of slots provide adjustability of the slot cover and mounting tabs'positions. When tightened the screws 80 clamp the slots cover 74, the upper air knife plate 68, the mounting tabs 82 and the air knife tightly together. A second or lower air knife plate 86 is welded or otherwise fastened to the underside of the mounting tabs 82. The second air knife plate has an arcuate front edge 88 as seen in FIG. 2. The thickness of the mounting tabs creates a small gap 90 between the upper and lower air knife plates (FIG. 4). This gap defines a pressure chamber through which air from the knife flows out as indicated by arrow E.

A conventional air delivery system operating in conjunction with the air knife 78 includes a source of compressed air supplied through a filter and moisture trap. The air supply is at about 60 to 100 psi. Details of the air knife 78 are shown in FIG. 4. Compressed air flows into a plenum chamber inside a case 92. It is then throttled through a slit opening or nozzle shown at 94 which extends the length of the case 92. The nozzle opening is a few thousandths of an inch and is adjustable. The air flow out the nozzle 94 adheres to the profile of the face of the case, thus turning the air stream 90° and directing it to flow over the face of the unit. This primary air stream immediately begins to entrain surrounding air while velocity loss is minimized through the wall attachment effect. The result is a high velocity, high volume sheet of air flowing into the air gap 90. A suitable air delivery case is available from Exair Corporation of Cincinnati, Ohio, under their trademark Exair-Knife.

The air delivery case creates a curtain of pressurized air between the plates 68 and 86. This air curtain is wider than the space between successive lands on the transfer wheel. This means there is a time period in which the entire mouth of a pouch is simultaneously exposed to a zone of high pressure. As a result, the pouch interior is subjected to air pressure of a great enough magnitude to cause the pouch to open or inflate fully. This is shown in FIG. 2 where a pouch 12A at the entry point is fully closed or flat while pouches 12B and 12C are fully open.

It will be noted that each pouch has a front panel 96 and a rear panel 98 defining a mouth 100 at the top of the pouch.

It can be seen that pressurizing a pouch requires that the air curtain and pouch be constrained so that the air curtain inflates the pouch and is not just dissipated to atmosphere. As used herein a "contained" pouch is one in a position to be affected by the pressure containment means. Although the arrangement of the first and second plate 68 and 86 shown has been found to be an effective pressure containment means, other arrangements could be used. For example, as shown the first plate 68 overlies the second plate 86 and the pouch is unbalanced so the plates can form the entire pressure chamber. Alternative arrangement could have the plates horizontally separated to define a gap between them. In this instance the upper plate would not overlie the lower plate. The unfilled pouch would span the gap between the plates. An additional cover over the two plates would be needed to complete the pressure chamber. Further alternatives include plates that engage the pouch panels somewhat below the very top edge. In other words, the pouch would extend above the panels into the pressure chamber.

It can be seen that the volume maximizing apparatus just described requires the air curtain to be contained and not simply diffused to atmosphere. The plates 68 and 86 serve the function of containing the air curtain but it is also required that the web be in contact with the underside of the plate. To achieve this the web must be maintained at a given height in relation to the plates. An adjustable web height guide system for maintaining the pouch at the proper height to accomplish this purpose is described in U.S. Pat. No. 5,699,653.

Figure 5:
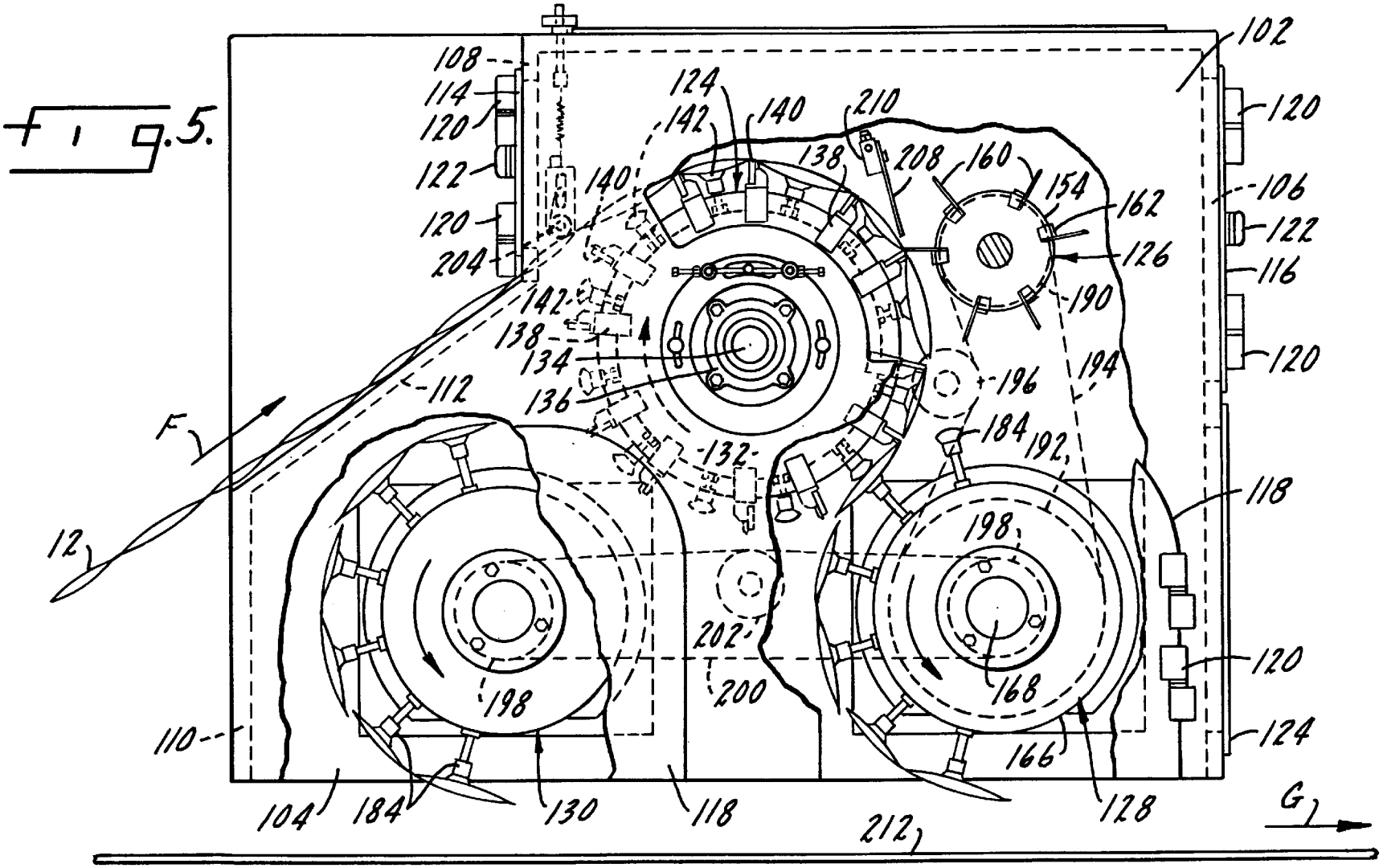
FIG. 5 is a side elevation view of the knife of the present invention.
Figure 6:
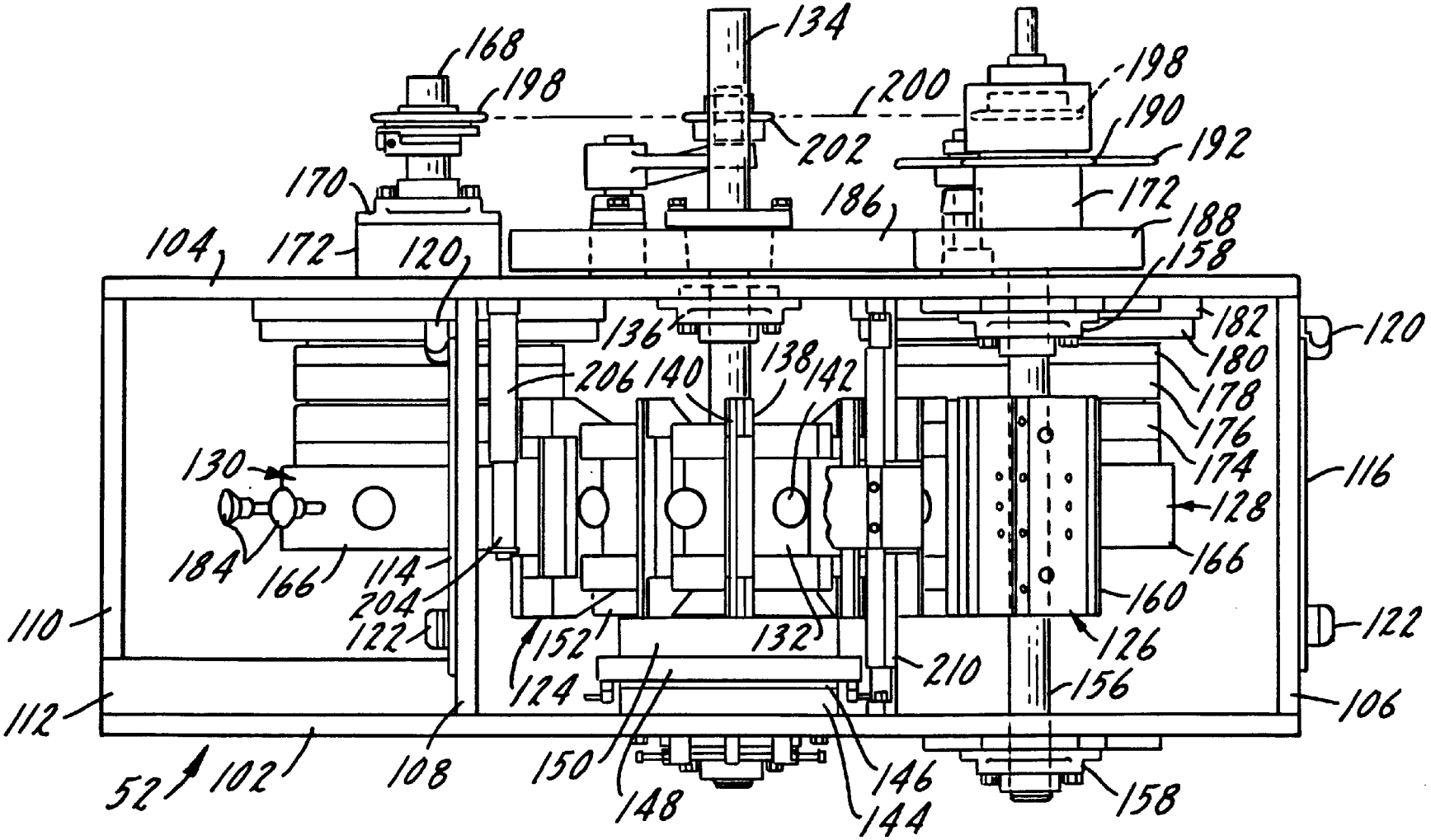
FIG. 6 is a top plan view of the knife of the present invention.

FIGS. 5 and 6 illustrate the knife 52 of the present invention. The knife has a case or frame including an outer knife side plate 102, an inner knife side plate 104, a back plate 106, an upper front plate 108 and a lower front plate 110. A filler plate 112 extends from the lower front plate 110 to the upper front plate 108. The upper front plate 108 as well as the back plate 106 and the outer side plate 102 have large openings providing access to the interior of the frame. These openings are covered or closed during use by doors or guards. There is a front door guard 114, a rear door guard 116 and a pair of transfer doors 118 covering openings in the front plate, rear plate and outer side plate, respectively. The doors are attached to the respective plates by hinges 120. Door knobs 122 are also provided. The back plate 106 also has a lower rear guard 124 which is held in place by screws instead of hinges.

The frame houses major knife and minor knife wheels, shown generally at 124 and 126 respectively. Beneath the knife wheels are first and second transfer wheels 128 and 130. The knives and transfer wheels are mounted for rotation as indicated by the arrows thereon. The means for effecting this rotation will be explained below.

Looking at details of the major knife 124, it has a hub 132 mounted on a shaft 134 which is carried in bearings 136. The bearings are mounted in the side plates 102 and 104. Spaced around the periphery of the hub 132 are a plurality of blade holders 138. The blade holders mount the major knife blades 140. It will be noted that the spacing of the blade holders and therefore of the knife blades is uneven or variable so as to match the multi-pitch widths of the packages. Intermediate the blade holders are a series of vacuum cup holders 142. The vacuum cup holders are attached to a hollow stem which is in communication with a vacuum system. The vacuum system includes a major vacuum position plate 144, a vacuum pressure plate 146, a shoe cover 148 and a major vacuum shoe 150. These parts are stationary and fixed to the outer knife side plate 102. A major wear plate 152 is attached to the hub 132. The vacuum system includes a series of passages through the hub 132 which communicate with the hollow stems of the cup holders. These components of the vacuum system are conventional.

Figure 7:
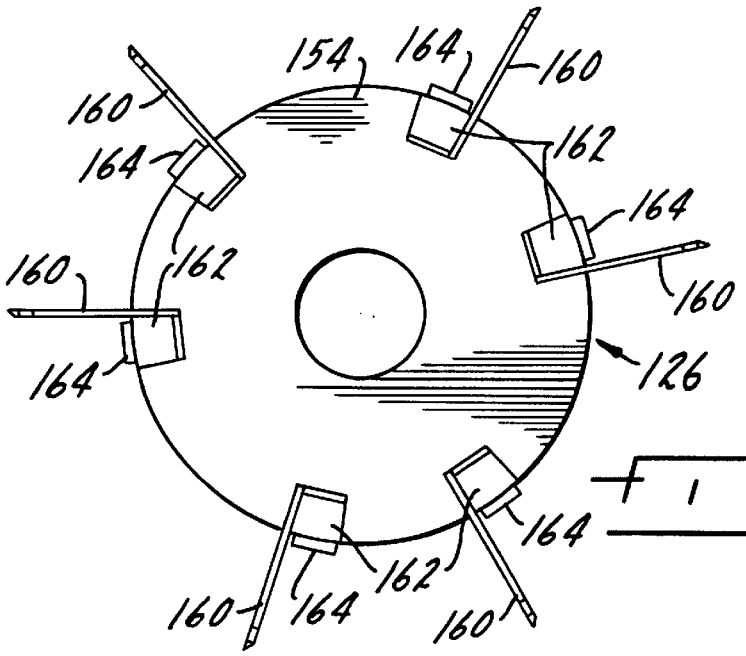
FIG. 7 is a side elevation view of the minor knife wheel on an enlarged scale.

The minor knife 126 has a hub 154 mounted on a shaft 156. The shaft is mounted for rotation in bearings 158 which are attached to the side plates 102 and 104. As best seen in FIG. 7, the hub has a series of sockets in its outer periphery. These sockets receive the minor knife blades 160. Each knife blade is held in its socket by a wedge 162 and associated insert 164. It will be noted that, as with the major knife hub, the spacing of the minor knife blades 160 is variable to accommodate the multi-pitch packages.

Turning now to the transfer wheels 128,130, they are virtually identical to one another so only one of the wheels will be described in detail. The transfer wheel has a hub 166 mounted for rotation on the end of a shaft 168. Shaft 168 is mounted in bearings, one of which is shown at 170. The bearings are attached to a spindle housing 172. The spindle housing itself is mounted in the inner knife side plate 104. Although it is not shown, the spindle housing extends through the inner side plate into the interior of the frame. The interior portion of the spindle housing is surrounded by parts of the vacuum system which include a transfer wear plate 174, a vacuum shoe 176, a manifold plate 178 and a vacuum position plate 180. The vacuum shoe, manifold plate and position plate are attached to a transfer slide plate 182. These parts are all fixed. The wear plate 174 rotates with the hub 166. The vacuum system is in communication with a plurality of vacuum cup holders 184 spaced about the periphery of the hub 166.

The drive system for the knife 52 includes a major gear 186 mounted on the major knife shaft 134 and a mating minor gear 188 mounted on the minor knife shaft 156. The major gear 186 is driven from a motor (not shown) associated with the pouch machine. The minor knife shaft 156 has a minor hub sprocket 190 attached thereto. One of the transfer wheel shafts 168 carries a transfer drive sprocket 192. A drive chain 194 connects sprockets 190 and 192. Chain 194 is a tensioned by an adjustable idler 196. This chain drives the transfer wheel 130. The transfer wheel shafts 168 each have mounted thereon a connector sprocket 198. The two connector sprockets are driven by a second chain 200. An adjustable idler 202 is provided for the second chain 200.

Other components of the knife include a wrap roller 204 mounted on a wrap extension 206. The wrap extension provides adjustable tension on top of the web of packages as it enters the major knife wheel. A similar function is provided on the other side of the major knife by a hold down plate 208 which is mounted on a hold down bar 210.

The use, operation and function of the knife are as follows. The web 12 of pouches comes in under the front door guard 114, moving in the direction of arrow F. The web is held down by the wrap roller 204. As the pouches are engaged by the cup holders 142, the vacuum system of the major knife wheel applies vacuum to the cups so that the packages are held fixed to the cup holders. The packages are arranged so their side seals are aligned with the major knife blades 140. At the point where the major knife blades mesh with the minor knife blades 160, the side seals are either perforated or sliced through to separate one package from the next. The center seal of a package is perforated to allow a package to be separated into two pouches. Again, the spacing of the knife blades is such that they will engage the variable pitch of the pouches. Once cut into individual packages, the packages are carried downwardly by the major knife until they are transferred to one of the transfer wheels 128, 130. Successive packages go to alternate transfer wheels. The vacuum controls are such that the vacuum is released from the major knife at the same time that it is applied to the transfer wheel so the packages are passed from the major knife to the transfer wheel. The transfer wheels carry the packages down to a conveyor shown at 212, which moves in the direction of the arrow G.

While a preferred form of the invention has been shown and described, it will be realized that alterations and modifications may be made thereto without departing from the scope of the following claims. For example, while it is preferred that the pouches have a lip, at least temporarily, when they enter the pouch opening device, with some materials it may be possible to have balanced pouches at the opening device. Also, air could be introduced through a slot in a single plate. The pouches would move directly beneath the slot with the back panel opening to the rear and the front panel opening to the front. Similarly, while contact between the pouch and plate 62 seems to work best, some applications may allow a slight separation and still produce satisfactory results. Further, while the air curtain shown and described is the preferred structure for introducing air into the pouch, other arrangements are possible.

What is claimed is:

1. In a pouch machine of the type which forms a series of pouches in a continuously moving web of pouch material, the pouches being defined by front and back panels and side seals and a closed bottom, the tops of the front and back panels prior to filling being open to define a mouth, the improvement comprising a first plate having a bottom surface engageable with the back panel and a second plate having a bottom surface engageable with the front panel, prior to filling the pouches, the plates defining at least a portion of a pressure chamber which is in communication with the mouth of the pouches, and a source of pressurized gas supplied to said chamber for opening the pouches to their maximum volume prior to filling by generating an internal pouch pressure high enough to separate substantially all unsealed portions of the front and back panels from one another.

2. The pouch machine of claim 1 wherein the pouch is unbalanced and the first and second plates are vertically spaced from one another.

3. The pouch machine of claim 2 wherein the first plate overlies the second plate and the source of pressurized gas introduces gas between the plates.

4. The pouch machine of claim 1 wherein at least one of the plates engages the uppermost edge of the panel with which it is engageable.

5. The pouch machine of claim 1 wherein the first and second plates are horizontally separated to define a gap between them and the pouch, when engaging the plates, spans said gap.

6. The pouch machine of claim 4 wherein the first plate is engageable with the uppermost edge of the back panel and a second plate is engageable with the uppermost edge of the front panel.

7. In a pouch machine of the type which forms a series of pouches in a web of pouch material, the pouches being defined by front and back panels joined by side seals and a closed bottom, the tops of the pouches prior to filling being open to define a mouth, an improved method of opening the pouches to their maximum volume prior to filling, comprising the steps of:

temporarily restricting air flow adjacent both the front and back panels of the pouch by engaging the back panel with bottom surface of a first plate and engaging the front panel with bottom surface of a second plate; and subjecting the full extent of the mouth of a pouch at one time to a zone of compressed air thereby pressurizing the pouch to an internal pressure high enough to separate substantially all unsealed portions of the front and back panels from one another.

8. In a pouch machine of the type which forms a series of pouches in a web of pouch material, the pouches being defined by front and back panels joined by side seals and a closed bottom, the tops of the pouches prior to filling being open to define a mouth, an improved method of opening the pouches to their maximum volume prior to filling, comprising the steps of temporarily restricting air flow adjacent both the front and back panels of the pouch by engaging the back panel with bottom surface of a first plate and engaging the front panel with bottom surface of a second plate in the vicinity of the mouth of a pouch and then pressurizing the pouch to an internal pressure high enough to separate substantially all unsealed portions of the front and back panels from one another.

9. The filler wheel of claim 7 wherein the uppermost edge of the back panel engages the bottom surface of the first plate and the uppermost edge of the front panel engages the bottom surface of the second plate.

10. The filler wheel of claim 8 wherein the uppermost edge of the back panel engages the bottom surface of the first plate and the uppermost edge of the front panel engages the bottom surface of the second plate.

* * * * *